United States Patent [19]

Torgeson

[11] Patent Number: 4,468,530

[45] Date of Patent: Aug. 28, 1984

[54] LOUDSPEAKER SYSTEM

[76] Inventor: W. Lee Torgeson, 4716 W. 60th St., Edina, Minn. 55424

[21] Appl. No.: 342,469

[22] Filed: Jan. 25, 1982

[51] Int. Cl.[3] ..... H04R 9/00

[52] U.S. Cl. ..... 179/115.5 PV

[58] Field of Search ..... 179/115.5 PV, 115 R, 179/111 R, 115.5 PS, 115.5 VC, 115.5 ES, 117; 181/163, 164

[56] References Cited

U.S. PATENT DOCUMENTS

| | | | |
|---|---|---|---|
| 1,643,791 | 9/1927 | Slepian . | |
| 1,808,149 | 6/1931 | Smith . | |
| 1,955,390 | 4/1934 | Schiffl . | |
| 3,066,200 | 11/1962 | Pavlak . | |
| 3,141,071 | 7/1964 | Rich . | |
| 3,164,686 | 1/1965 | Tibbetts . | |
| 3,171,904 | 3/1965 | Poutot . | |
| 3,209,084 | 9/1965 | Gamzon et al. . | |
| 3,283,086 | 11/1966 | Evans . | |
| 3,599,020 | 8/1971 | Harris . | |
| 3,674,946 | 7/1972 | Winey | 179/115.5 PV |
| 3,829,623 | 8/1974 | Willis | 179/115.5 PV |
| 3,898,598 | 8/1975 | Asahi . | |
| 3,919,499 | 11/1975 | Winey . | |
| 3,922,504 | 11/1975 | Kishikawa et al. . | |
| 4,020,296 | 4/1977 | Dahlquist . | |
| 4,081,627 | 3/1978 | Crist | 179/115.5 PV |
| 4,156,801 | 5/1979 | Whelan | 179/115.5 PV |
| 4,210,786 | 7/1980 | Winey . | |

OTHER PUBLICATIONS

"Magneplanar® Loudspeakers", Audio Research Corp., Advertisement.

*Primary Examiner*—G. Z. Rubinson
*Assistant Examiner*—L. C. Schroeder
*Attorney, Agent, or Firm*—Buell, Blenko, Ziesenheim & Beck

[57] ABSTRACT

One aspect of the invention is an integrated induction speaker which produces coherent high frequency and low frequency output. In this embodiment, the high frequency unit is centered between the two split halves of the low frequency unit. Another aspect of the invention is a configuration for a midrange or bass speaker having a very uniform magnetic field and excellent linearity.

20 Claims, 9 Drawing Figures

Fig. 3.
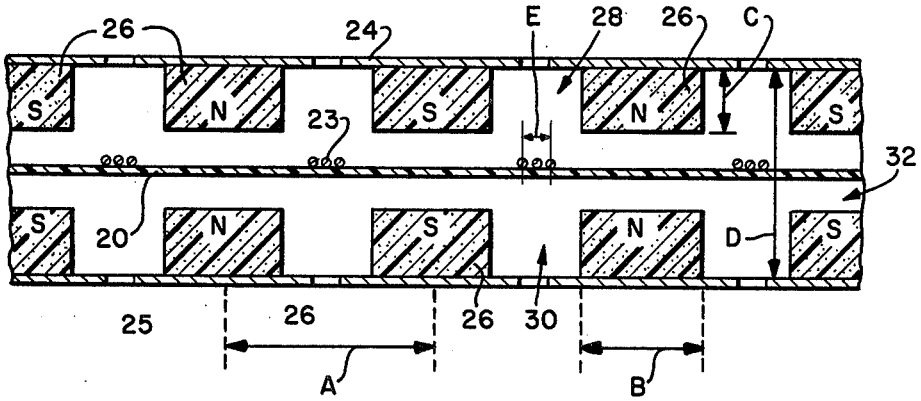
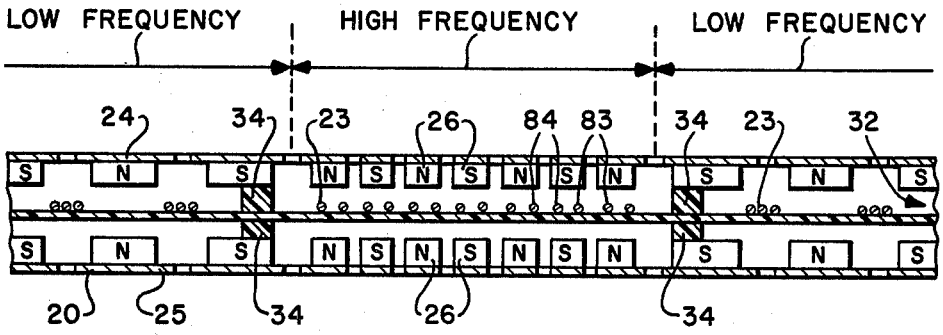
Fig. 4.
Fig. 9.
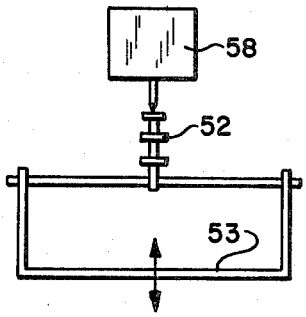

LOUDSPEAKER SYSTEM

BACKGROUND AND SUMMARY OF THE INVENTION

Dynamic direct-radiator loudspeakers of the moving coil type are not capable of operation over a wide frequency range without comparatively severe phase shift and interference effects caused by cone breakup and translation losses. Full range electrostatic loudspeakers, on the other hand, are capable of operation without breakup and translation losses, but suffer from serious problems with respect to directivity because of the large size required for effective bass reproduction. Also, speakers of that type require high operating voltages.

The foregoing problems are minimized by the use of the loudspeaker of the invention. According to one aspect of the invention, a loudspeaker having a balanced (push-pull) electromagnetic drive is provided which is optimized with respect to linearity and efficiency by the configuration of the magnets and conductors. As a result of the configuration, the conductors are subjected to a very uniform magnetic field. The uniformity of the magnetic field is of particular consequence in low or mid frequency portions of the loudspeaker, because the excursions of the diaphragm at high power are greater in these regions. This is especially true in long-throw speakers, wherein peak to peak excursion of the diaphragm may be 0.2 inches or greater.

According to another aspect of the invention, the loudspeaker includes low and high frequency units which are integrated in a single coaxial planar assembly, with the high frequency unit centered between the split halves of the low frequency unit. Sounds produced by the coaxial plane array of this type appear to originate in the center of the array. This configuration results in an excellent transient response. The loudspeaker may be an integrated low and high frequency assembly which serves as a full range loudspeaker. When used in this way, the speaker will usually be mounted on a baffle. Alternatively, the invention may take the form of an integrated mid-frequency, high-frequency assembly which is combined with a low frequency unit. The latter may be either a long-throw induction speaker of the type described herein or a matched moving-coil speaker.

For a more complete understanding of the above and other features and advantages of the invention, reference should be made to the following detailed description of the preferred embodiments thereof and to the accompanying drawings.

DESCRIPTION OF THE DRAWINGS

FIG. 3 is a cross sectional view of a low frequency unit according to one aspect of the invention.

FIG. 4 is a cross sectional view of an integrated low frequency, high frequency speaker according to the invention.

FIG. 9 is a front elevational view of the apparatus of FIG. 8.

DETAILED DESCRIPTION OF THE INVENTION

Figure 1:
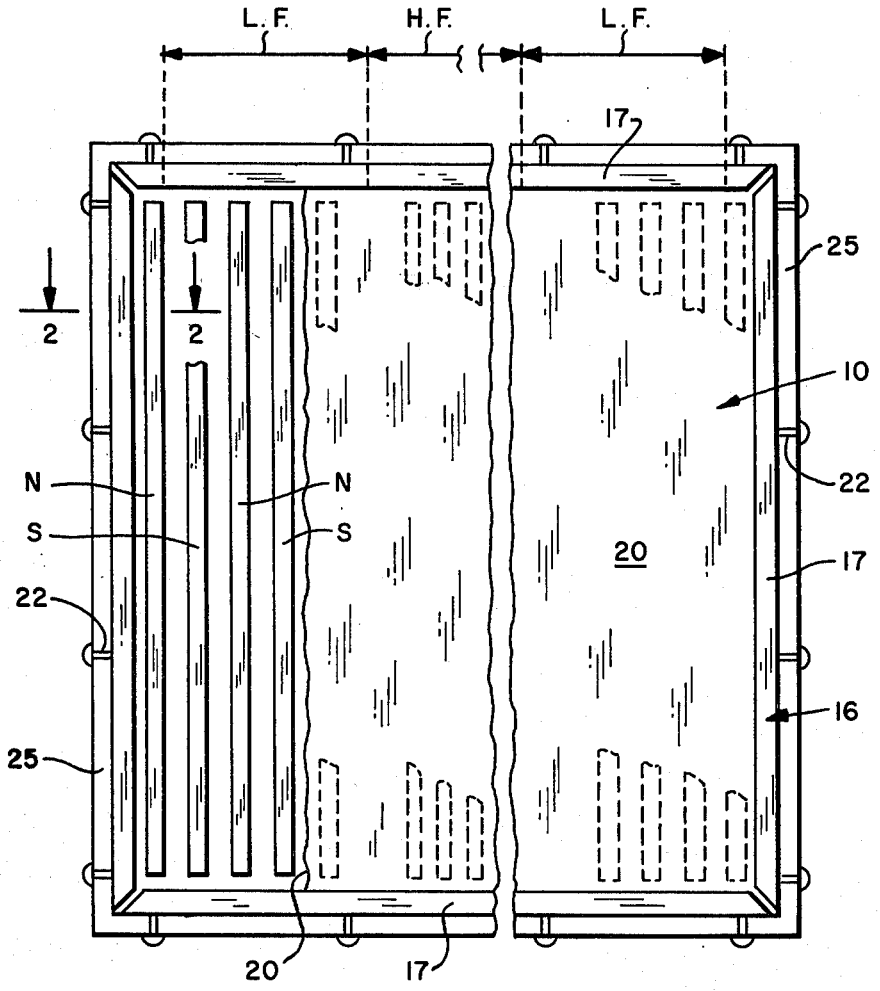
FIG. 1 is a sectional view of a preferred embodiment of an integrated full range loudspeaker according to one aspect of the invention, as taken along the lines 1—1 of FIG. 2.

A preferred embodiment of the invention comprises an integrated high frequency/low frequency loudspeaker 10 (see FIG. 1). The loudspeaker 10, which may be mounted on a baffle similar to baffle 37 shown in FIGS. 5 and 6, includes a pair of parallel steel, self-supporting stiffened, perforated panels 24, 25 secured together by spacers 12. A plurality of vertically disposed parallel strips of magnetic material 26 (e.g., magnetic rubber, such as Plastiform available from the 3M Company) are attached to each of the perforated panels. The magnetic strips are attached to the panels in like, opposed pairs alternating in polarity across the face of the panels. There are thus two opposing arrays 28 and 30 of magnetic strips and the individual strips of array 28 are directly opposed to those of the other array 30, as is evident in FIGS. 1–4. The face polarity and dimensions of each pair of facing magnetic strips 26 are the same. The direction of polarization of the magnets is perpendicular to the plane of the panel 24. The pairs of facing magnets are separated by a predetermined air gap 32, as established by the spacers 12 and the combined thickness of a pair of magnets.

A tension frame 16 fabricated from mitred individual plastic frame rails 17 are movably affixed to the perforated steel front panel 25 by means of a rubber or neoprene foam spacer strip 18. The spacer strip is bonded to both the frame rails 17 and to the panel 25 with a compatible contact adhesive, such as 3M 4693 Scotch Grip. The plastic rails 17 of the frame may, for example, be 0.25 inch by 1.0 inch in cross sectional dimensions. The corners of the frame member are joined as by screws or ultrasonic welding.

A thin plastic film 20 is cemented by its edges to the frame rails 17 and forms a speaker diaphragm. The film may, for instance, be 0.25 mil thick Mylar polyester. Screws 22 attached to frame rails are installed at intervals along the bent-over periphery 27 of the front panel 25 for tensioning the film 20. The film desirably is stretched substantially to the yield point prior to attachment to the frame 16. Further, adjustment of the tension, if required, is achieved by means of the screws 22. It is important that the film be uniformly tensioned for best results. Strips 90, of closed cell foam are cemented on their one side of the diaphragm 20, and on their other side and to the rear panel 24. The strip 90 functions to seal the edges of the unit.

As seen in FIGS. 3 and 4, electrical conductors 23 are attached to the diaphragm film 20. In the low frequency section of the speaker, the preferred location for the conductors is midway between adjacent pairs of the magnets as shown in FIG. 3. The conductor positioning is less critical in the high frequency section but conductors are nevertheless symmetrically located with respect to the space between adjacent pairs of magnets. In either section, the conductors are arranged such that the current flows through groups of adjacent conductors in the same direction. Since the driving force is proportional to the number of passes used, multiple passes of the conductors are generally preferred because the loudspeaker efficiency is increased thereby. Single passes may, however, be advantageously used in the high frequency unit to minimize the mechanical mass.

Typically, the conductors will be wires of round cross section. The preferred material for use as a conductor is aluminum, which minimizes the mechanical mass and thereby results in increased efficiency. The conductors may be cemented to the diaphragm film 20. In the event Mylar film is used, polyester adhesives such as DuPont 46950 are preferably employed in cementing the conductors to the film. Rubber-like adhesives such as 3M Scotch Grip 4693 have been found to be satisfactory for low frequency units. Alternatively, conductors may be fabricated economically by photoetching or chemical milling techniques.

Figure 7:
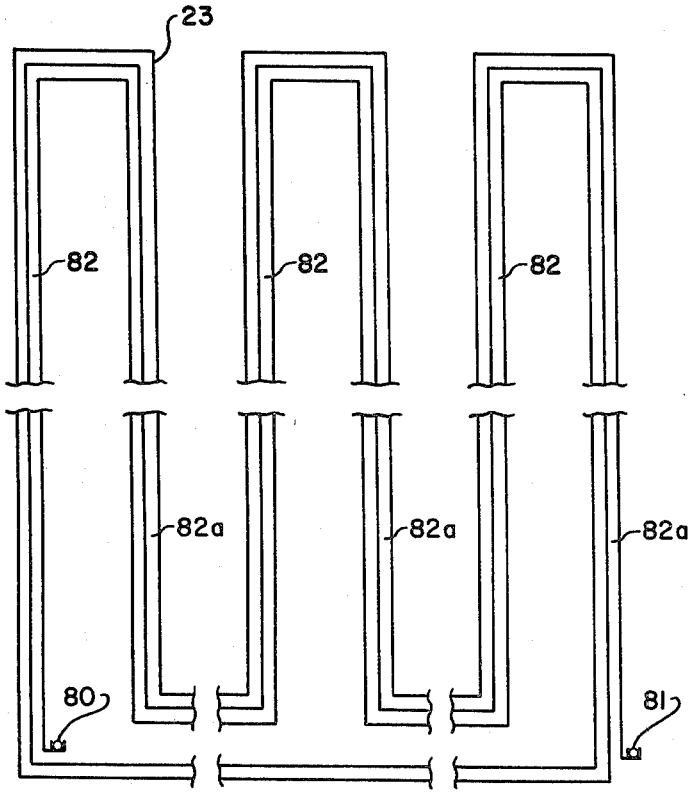
FIG. 7 is a view of a typical pattern for a conductor in a high linearity bass unit according to the invention.

A typical configuration of conductors is reflected in FIG. 7, which is illustrative of a bass section conductor, for example. As shown, a continuous conductor 23 has end points 80, 81 connected to the driver circuitry. The conductors are arranged in groups 82 of, e.g., three conductors. Each of the conductor groups 82 is arranged on the same side of the diaphragm centrally in the space between adjacent N-S pairs of magnets on the same side, as is evident in FIGS. 2 and 3. It will be noted in tracing the path of the conductor, that the direction of current flow at any moment will be the same in any group. If, for example, the instantaneous current is flowing in the direction of end point 81, the instantaneous flow in the conductor groups 82 will be upward, while the instaneous current flow in the adjacent conductor groups 82*a* will be downward. Of course, the conductor configuration for the high frequency section is similarly designed such that conductor groups positioned generally opposite the spaces between adjacent N-S magnet pairs on the same side have instantaneous currents flowing in the same direction. With reference to FIG. 4, for example, if the conductors 83 have, for example, instantaneous inward current flow (with respect to the plane of the paper), the adjacent conductor pair 84, located opposite the adjacent gap between an N-S magnet pair, will have an instantaneous outward current flow.

An important element in this aspect of the invention is the location of the high frequency section in relation to the bass (or midrange) sections. As seen in FIGS. 1 and 4, the high frequency unit is centrally located, with low frequency elements on both sides. Vertical separator strips 34, which may be strips of live rubber or other separating means, are mounted on opposite sides of the diaphragm 20 and extend to opposed magnet strips. As a result, the high frequency section is effectively isolated from the comparatively large excursions of the adjacent low frequency sections. The arrangement of the low frequency sections flanking the high frequency element results in a speaker in which both elements have the same center. Since all sounds produced by either or both elements appear to emanate from the center of the array, this loudspeaker is able to produce sounds with minimal phase shift and interference over a wide frequency range.

The Mylar or comparable diaphragm material provides a low mass membrane which has a desirably high yield stress. In use, the Mylar membrane is tensioned close to its yield stress. Theoretical studies have indicated that the required spacing of the conductors is frequency dependent. If the conductor spacing is too wide, the acoustic output below the frequency at which mass limiting occurs increases steadily above a "critical" frequency which depends on the membrane thickness and tension and on the conductor spacing. This behavior is caused by the dynamic deflection of the membrane between the conductors. Flat acoustic output may be achieved by designing for mass controlled roll-off at or below the frequency at which membrane deflection becomes a factor. Furthermore, the acoustic mass may be adjusted to tailor the response at high frequencies by altering the spacing of the magnets and the panels since the restrictions in area resulting from the magnets and the panels (see FIG. 4) increase the acoustic inertia sufficiently to affect the response which would otherwise occur. In a prototype loudspeaker constructed in accordance with FIGS. 3 and 4, a flat, high frequency response extending to 22,000 Hz was obtained in this manner. Thorough measurement has shown that minimal spurious output occurs with loudspeakers of this type, provided that the conductor spacing is carefully selected and, most importantly, that the membrane is uniformly tensioned.

Figure 5:
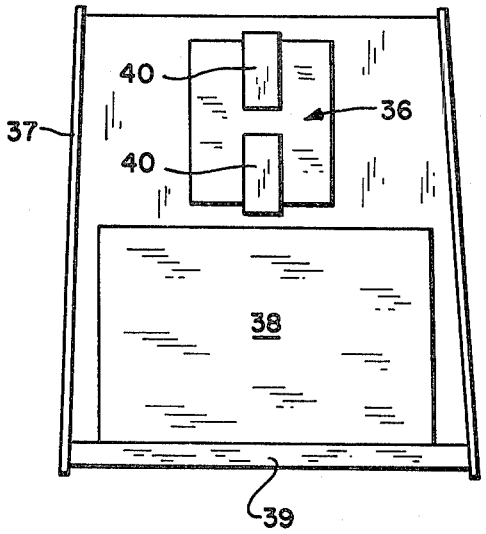
FIG. 5 is a front elevational view of an alternate preferred embodiment of the invention having an integral high frequency/medium frequency unit and a separate low frequency unit.
Figure 6:
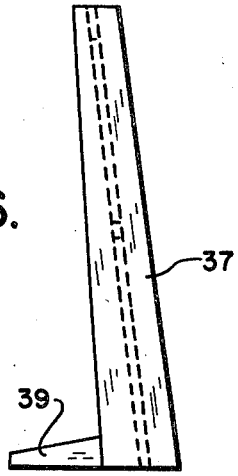
FIG. 6 is a side elevational view of the embodiment of FIG. 5.

An alternate preferred embodiment of the invention is shown in FIGS. 5 and 6. In this embodiment, there is an integrated unit 36 designed to function as a medium frequency/high frequency unit and a separate bass unit 38 is used. Both units are mounted in an upright baffle 37 supported by a base 39. If a low-energy magnetic material (e.g., type PLI Natsyn Plastiform from 3-M Company), is used, a long, narrow high frequency radiator is required to acheve acoustic output matching the bass unit. An acoustic lens 40 is employed in this case to prevent vertical "beaming" of the high frequency sound. Lateral beaming is avoided by using a narrow high frequency unit; e.g., 1.5 inches wide.

The lens 40 includes a number of thin aluminum or plastic sheets which are equally spaced (e.g., about 0.2 inches) at the base and inclined at progressively increasing angles from the center of the loudspeaker to the edges so that the profile of the outer edge of the lens is a circular arc. As viewed in a vertical plane, sound waves generated by the high-frequency loudspeaker emerge from the lens with a circular wave front. This avoids vertical beaming. Alternatively, beaming may be prevented by use of high energy magnets, such as samarium-cobalt ceramic magnets, in the high-frequency unit. The HF unit may then be reduced in size so that, with proper design, satisfactory vertical and horizontal sound distribution may be produced without a lens. Another approach, which is effective even for low-energy magnetic materials, is to scale down the dimensions of the electromagnetic system. This does not change the field strength at the conductor locations but increases the acoustic output per unit area because of the increased vibratory force per unit area.

The integrated high frequency/low frequency long throw, linear loudspeaker of the invention should not be mounted in an enclosure. The most natural sound is obtained when the integrated driver assembly is mounted on a flat baffle (see FIG. 6) which does not restrict the radiation from the rear of the loudspeaker. Despite the lower acoustic loading of the bass unit with this type of operation (as compared with a loudspeaker installed in an infinite baffle), essentially flat acoustic output is possible over the frequency range from 30 to over 20,000 Hertz. This is a direct result of the long-throw electromagnetic system, which permits comparatively large excursions with very low distortion.

To fully realize the potential benefits of the speaker arrangement according to the invention, the following conditions should be met:

(a) The high and low frequency loudspeaker elements should vibrate coherently when excited by sine wave signals and should have smooth frequency response extending well beyond the crossover frequency, (b) The individual elements should be compatible with a 6 db per octave crossover characteristic (i.e., a quarter-section network), (c) The acoustic output levels of the high and low frequency elements should be matched, and (d) The crossover frequency should be far above the resonant frequency of the high frequency element. The quarter-section network is characterized by the fact that the low-pass and high-pass outputs can be recombined without phase shift; i.e., a square wave input can be recovered at the output by adding the low and high frequency signals. Under these conditions, a smooth, interference-free crossover between the low and high frequency sections of the loudspeaker are possible. This is very important in achieving realistic transient response.

It is important to note the different considerations which come into play in the high frequency and low frequency aspects of the speaker. Close conductor spacing and low mechanical mass are necessary for extended range high frequency response. Thus, it will be seen in FIG. 4, that there is a much larger spacing between each group of conductor passes in the bass section of the speaker than in the high frequency region. An appropriate low frequency conductor spacing for the configuration shown is 0.65–0.75 inches between the centers of the conductor in adjacent spaces. An appropriate conductor spacing in the high frequency section is about 0.125 inches between each pass, the passes being equally spaced and having two passes per magnet. Although equal spacing of the conductors in the high frequency elements is preferred, it is not required. Single conductor passes may be used to minimize the mechanical mass in the high frequency region. As mentioned above, mechanical mass is also minimized by use of aluminum conductors.

On the other hand, for low frequency reproduction, linearity is most important. That is, the magnetic field must be uniform so that the conductors are exposed to the same field wherever the excursions of the diaphragm brings them; otherwise substantial distortion will result. This factor is much more important in a low frequency speaker because large excursions are required to produce low frequencies at high power levels. In the loudspeaker of the invention, peak-to-peak excursions as large as 0.35 inch can be achieved with low distortion.

The electromagnetic drive configuration for a low-distortion bass loudspeaker according to the invention results in substantially linear excursions. The specific configuration and dimensions of the magnets and conductors of the loudspeaker are significant factors in the production of a linear low frequency output. This aspect of the invention may be in conjunction with or apart from the integrated speaker described above. The relevant parameters for producing a uniform magnetic field and linear response in accordance with the invention are the lateral spacing between the magnets, the width and thickness of the magnets, the combined heights of the pair of facing magnets plus the distance across the air gap, and the spacing between multiple conductor passes. Another factor is the number N of conductor passes per space. Representative dimensions which will produce a suitably linear bass reproduction in accordance with this aspect of the invention for the configuration of FIG. 3 are as follows:

Distance A, the distance from the center of one magnet to the center of the adjacent magnet: 0.75 inches;

Distance B, the face width of the magnets: 0.375 inches;

Distance C, the thickness of the magnets: 0.25 inches;

Distance D, the distance from the front metal supporting panel to the rear panel (i.e., the combined heights of the pair of facing magnets plus the distance across the air gap): 0.85 inches.

Distance E, the distance between the centers of the first and last conductors; 0.08 inches, where N, the number of conductor passes between magnets is 4.

The dimensions may be scaled up or down to suit a given application. Thus, the following approximate ratios for dimensions A, B, C, D and E, respectively, may be used: 3.0:1.5:1.0:3.4:0.32. When supplied with a constant current, the drive force of the configuration illustrated in FIG. 3, having the dimensions recited above, has been found to be uniform to within 0.5 percent for peak-to-peak excursions of 0.25 inches or less. These results are indicative of excellent linearity and are in very good agreement with theoretical studies of the electromagnetic system shown in the figure.

An alternate preferred embodiment has the following dimensions and ratios for the low frequency speaker of FIG. 3:

| | Distance (Inches) | Ratio |
|---|---|---|
| A | 0.65 | 2.6 |
| B | 0.375 | 1.5 |
| C | 0.25 | 1.0 |
| D | 0.75 | 3.0 |
| E | 0.04 | 0.16 |
| (N = 3) | | |

This embodiment has also been calculated to yield excellent linearity. For best results in low frequency reproduction, a large membrane area is needed. A bass loudspeaker having an effective area 15 by 28 inches in size, with the alternate preferred electromagnetic configuration above has excellent output to below 30 Hertz.

An embodiment which is particularly advantageous for high output at low frequencies employs four conductor passes (N=4):

| | Distance (Inches) | Ratio |
|---|---|---|
| A | .73 | 2.92 |
| B | .375 | 1.50 |
| C | .25 | 1.00 |
| D | .85 | 3.40 |
| E | 0.09 | 0.36 |

Figure 8:
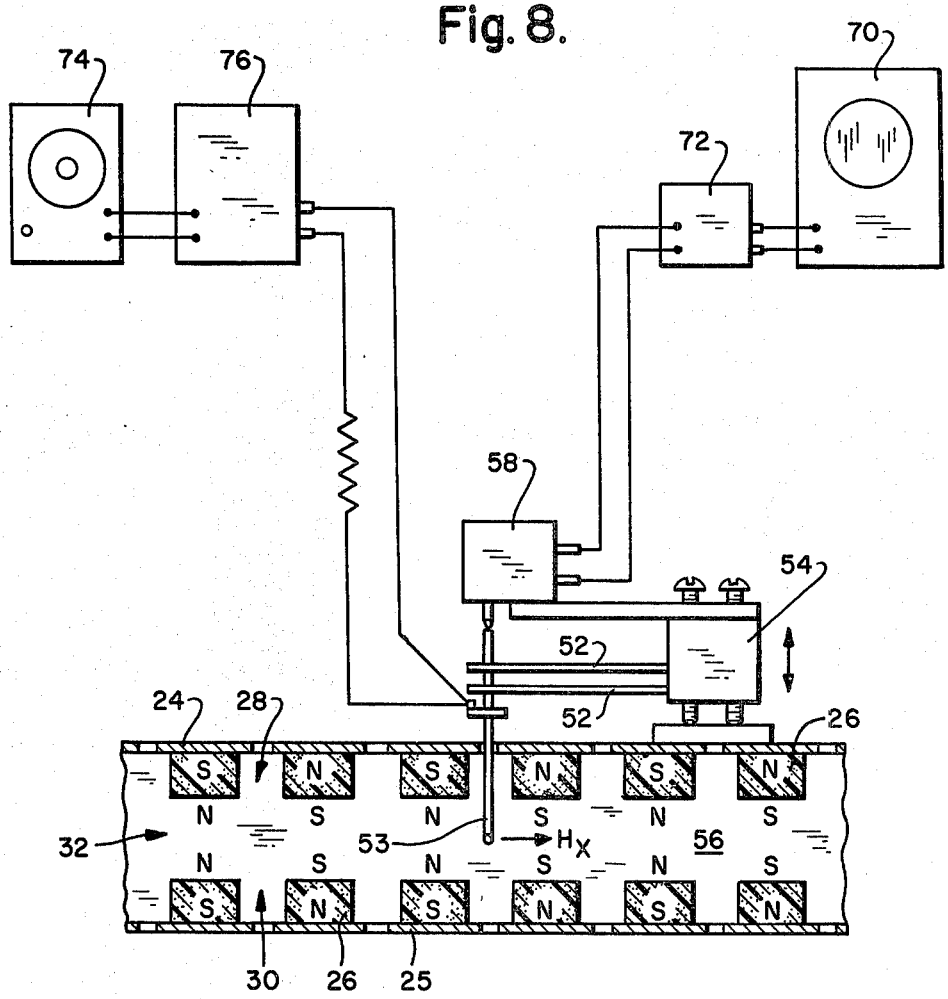
FIG. 8 is a side elevational view of an apparatus used for testing the linearity of a magnetic configuration shown testing a magnetic configuration.

An experimental investigation of a magnetic field according to the invention was carried out with the apparatus shown in FIGS. 8 and 9. As indicated therein, a U-shaped search probe 53 is mounted on cantilevers 52, rigidly attached to a base 54 which can be raised or lowered with respect to the magnetic assembly 56. With the probe positioned in the magnetic field, vibrating motion of the search probe assembly can be induced by passing alternating current (produced by an audio oscillator 74 and an audio amplifier 76) through the probe. For a given current, the amplitude of vibration is proportional to the transverse magnetic field component Hx. This motion is detected by means of a crystal transducer 58 mounted on the base 54 to which the cantilevers are attached. Output from the pick-up is amplified by a preamp 72 and fed to a oscilloscope 70.

A frequency near reasonance was selected and the exciting current was adjusted to achieve a peak-to-peak amplitude of about 8 cm on the oscilloscope with the probe centered in the magnetic gap.

It was found that no detactable variation of amplitude occurred for positions up to ±0.125 inches from the center position for A=0.65 inches, B=0.375 inches, C=0.25 inches and D=0.75 inches. Then, the lower magnetic assembly (i.e., the bottom array of magnets) was removed and the test repeated. The percentage change in field was +13.8% for a 1/32" displacement and +41% for a ⅛" displacement (the probe was displaced toward the magnets in both cases). These results demonstrate that use of the configuration according to the invention results in an extremely linear response. The results also indicate the importance of the push-pull design of the loudspeaker since the results for "single ended" operation (lower magnetic assembly removed) were markedly inferior to those for the push-pull operation.

The special magnetic properties of the "magnetic rubber" used in the unit are a significant factor in obtaining these results. The incremental permeability of the magnetic material is just slightly greater than that of air. If the magnets are uniformly magnetized (which can be easily done) the magnetic system illustrated by FIG. 3 produces a very uniform magnetic field in the region traversed by the conductors.

Another important characteristic of the loudspeaker should be noted: unlike direct-radiator loudspeakers, whose damping is almost entirely due to mechanical losses in the loudspeaker mechanism, the induction loudspeaker described here owes most of its damping to the resistive component of the radiated sound. This is believed to be a desirable characteristic, since the excursion of the vibrations membrane can adapt to the instantaneous acoustic loading. In effect, this may compensate to a degree for adverse factors in the acoustic environment.

Figure 2:
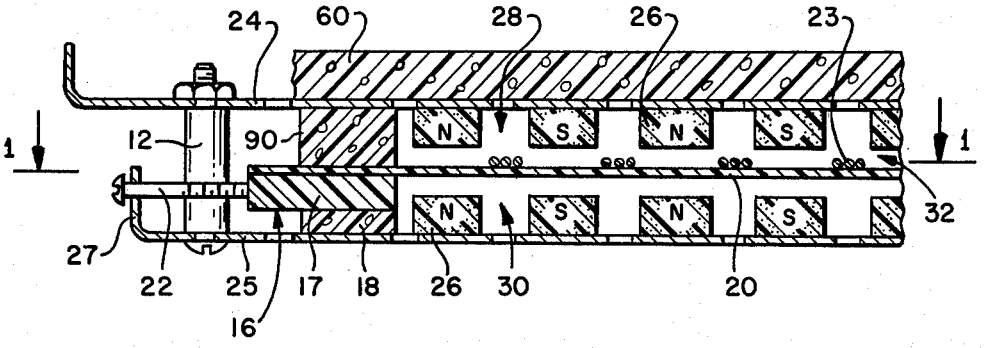
FIG. 2 is a partial sectional view taken along the lines 2—2 of the embodiment of FIG. 1.

Sufficient damping should, however, be provided in the low-frequency unit to control the output near the resonant frequency. As shown in FIG. 2, the necessary damping can be achieved by gluing a sheet of open-cell foam 60 to one of the perforated steel panels in the region of the bass section (see FIG. 1). The porosity of the foam, its thickness and the percentages of open area of the perforated steel panel must be selected to achieve adequate damping coupled with essentially flat sound output near the resonant frequency. As is the case with baffled direct-radiator loudspeakers, the damping, effective mass and compliance are controlling factors in the bass response. The induction loudspeaker described here achieves excellent bass response because of the large size and low mass of the vibrating membrane and because of the linear long-throw electromagnetic system used in the bass driver.

While the specific configurations of magnets and conductor disclosed herein are particularly useful for long-throw bass loudspeakers (e.g., bass speakers) permitting peak-to-peak diaphragm excursions of 0.2 inches or greater), the configurations will also yield linear output at excursions of lesser magnitude (e.g., in high frequency and medium frequency units.)

It should be understood, of course, that the specific form of the invention herein illustrated and described is intended to be representative only, as many changes may be made therein without departing from the clear teachings of the disclosure. Accordingly, reference should be made to the following appended claims in determining the full scope of the invention.

I claim:

1. A loudspeaker which comprises:

(a) first and second flat steel perforated sheets, (b) a first row of longitudinally extending magnets of alternating polarity, mounted on said first steel sheet with perforations between the magnets, (c) a second row of longitudinally extending magnets of alternating polarity mounted on said second steel sheet with perforations between the magnets, (d) means spacing said first and second sheets, to space said second row from said first row by an air gap, (e) magnets of like polarities and dimensions in said respective row facing and being parallel to each othe across said gap, (f) a diaphragm situated midway in said gap between said respective magnet rows, (g) a plurality of conductors supported by said diaphragm and extending parallel to said longitudinally extending magnets, (h) said magnets and conductors and diaphragm arranged to form a high frequency speaker element in the central region of said magnet rows and low frequency or mid-frequency regions on either side of said high frequency region.

2. The loudspeaker of claim 1, wherein the high and low frequency regions are isolated by separating means.

3. The loudspeaker of claim 2, wherein said separating means comprise strips of live rubber.

4. The loudspeaker of claim 1, further comprising means for uniformly tensioning said diaphragm.

5. The loudspeaker of claim 1, wherein said diaphragm is a Mylar polyester membrane tensioned to approximately the yield point.

6. The loudspeaker of claim 1, wherein (a) in the high frequency section the conductors are arranged in sets comprising a plurality of longitudinally extending passages which are spaced approximately 0.125 inches apart, (b) in the low frequency section the conductors are arranged in sets comprising a plurality of longitudinally extending passes substantially centered between a pair of adjacent magnets on the same side, and (c) the distance between the midpoint of the conductor passes of each set is between approximately 0.65 and 0.75 inches.

7. A loudspeaker which comprises:

(a) first and second flat steel perforated sheets, (b) a first row of longitudinally extending magnets of alternating polarity, mounted on said first steel sheet with perforations between the magnets, (c) a second row of longitudinally extending magnets of alternating polarity mounted on said second steel sheet with perforations between the magnets, (d) means spacing said first and second sheets, to space said second row from said first row,
(e) magnets of like polarities and dimensions in said respective rows facing and being parallel to each other across said gap,
(f) a diaphragm situated midway in said gap between said respective magnet rows,
(g) conductor means supported by said diaphragm and extending parallel to said longitudinally extending magnets,
(h) said conductor means being centered in the spaces between adjacent magnets on the same side of said diaphragm,
(i) the ratio of the distance (A) between the center of one magnet and the center of an adjacent magnet on the same side to the width (B) of the magnet to the thickness (C) of the magnet to (D) the combined thickness of a pair of opposed magnets plus the distance across the air gap being approximately 3:1.5:1:3.4.

8. The loudspeaker according to claim 7, wherein the magnets are uniformly magnetized magnetic rubber.

9. The loudspeaker according to claim 7 or 8, wherein the distance across said gap between facing magnets is at least 0.2 inches.

10. The loudspeaker according to claim 7, wherein
(a) distance (A) is approximately 0.75 inches,
(b) distance (B) is approximately 0.375 inches,
(c) distance (C) is approximately 0.25 inches,
(d) distance (D) is approximately 0.85 inches,
(e) N, the number of conductor passes per space between adjacent magnets is 3 or 4, and
(f) the distance (E) is between the center of the first and last conductor passes in any single space between adjacent magnets is approximately 0.05 inches for N=3 and approximately 0.08 inches for N=4.

11. The loudspeaker according to claim 7 or 9, wherein the ratio of distance (C) to the distance (E) between the centers of the first and last conductor passes in any single space between adjacent magnets is approximately 1:0.32.

12. The loudspeaker according to claim 7 or 10, wherein the magnets are uniformly magnetized material having an incremental permeability of about 1.0.

13. A loudspeaker unit, which comprises
(a) first and second flat steel perforated sheets,
(b) a first row of lognitudinally extending magnets of alternating polarity mounted on said first steel sheet with perforations between the magnets,
(c) a second row of longitudinally extending magnets of alternating polarity mounted on said second steel sheet with perforations between the magnets,
(d) means spacing said first and second sheets, to space said second row from said first row,
(e) magnets of like polarities and dimensions in said respective rows facing and being parallel to each other across an air gap,
(f) a diaphragm situated centrally in said gap between said respective magnetic rows,
(g) conductor means supported by said diaphragm,
(h) the passes of said conductor being centered in the spaces between adjacent magnets on the same side,
(i) the ratio of the distance (A) from the center of one magnet to the center of an adjacent magnet on the same side to the width (B) of the magnet to the thickness (C) of the magnet to the combined thickness (D) of two facing magnets plus the distance across the air gap being approximately 2.6:1.5:1:3.

14. The loudspeaker according to claim 13, wherein the magnets are uniformly magnetized magnetic rubber.

15. The loudspeaker according to claim 13, wherein the ratio of distance (C) to a distance (B) between the centers of the fist and last conductor passes in any single space between adjacent magnets is approximately 1:0.16 for N=3 or approximately 1:0.32 for N=4.

16. The loudspeaker according to claim 14 or 15, wherein the distance across said gap between facing magnets is 0.2 inches or greater.

17. The loudspeaker according to claim 15, wherein the
(a) distance A is approximately 0.65 inches,
(b) distance B is approximately 0.375 inches,
(c) distance C is approximately 0.25 inches,
(d) distance D is approximately 0.75 inches,
(e) distance E is approximately 0.04 inches for N=3 or approximately 0.08 inches for N-4.

18. The loudspeaker of claims 7 or 8 or 9 or 11 or 13 or 14 or 15 or 17, further comprising
(a) a high frequency speaker section centrally located between the split halves of the bass or midrange sections,
(b) said high frequency section being comprised of a common diaphragm with said bass or midrange sections.

19. The loudspeaker of claim 11 further comprising
(a) a high frequency speaker section centrally located between the split halves of the bass or midrange sections,
(b) said high frequency section being comprised of a common diaphragm with said bass or midrange sections.

20. The loudspeaker according to claim 12, 14 or 16, wherein the magnets are uniformly magnetized magnetic material with an incremental permeability of about 1.0.

* * * * *